US007288181B2

(12) United States Patent
Shih et al.

(10) Patent No.: US 7,288,181 B2
(45) Date of Patent: Oct. 30, 2007

(54) PRODUCING LOW SULFUR NAPHTHA PRODUCTS THROUGH IMPROVED OLEFIN ISOMERIZATION

(75) Inventors: Stuart S. Shih, Baton Rouge, LA (US); David L. Stern, Baton Rouge, LA (US); Madhav Acharya, Vienna, VA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 323 days.

(21) Appl. No.: 10/887,681

(22) Filed: Jul. 9, 2004

(65) Prior Publication Data

US 2005/0029162 A1 Feb. 10, 2005

Related U.S. Application Data

(60) Provisional application No. 60/492,079, filed on Aug. 1, 2003.

(51) Int. Cl.
*C10G 69/02* (2006.01)

(52) U.S. Cl. ..... 208/89; 208/97; 208/143; 208/218

(58) Field of Classification Search ..... 208/89, 208/97, 143, 218
See application file for complete search history.

(56) References Cited

U.S. PATENT DOCUMENTS

| | | | | |
|---|---|---|---|---|
| 3,736,251 | A * | 5/1973 | Hayes | 208/143 |
| 5,254,789 | A | 10/1993 | Gajda | 585/671 |
| 5,298,150 | A | 3/1994 | Fletcher et al. | 208/89 |
| 5,318,690 | A | 6/1994 | Fletcher et al. | 208/89 |
| 5,320,742 | A | 6/1994 | Fletcher et al. | 208/89 |
| 5,326,462 | A | 7/1994 | Shih et al. | 208/89 |
| 5,360,532 | A | 11/1994 | Fletcher et al. | 208/89 |
| 5,500,108 | A | 3/1996 | Durand et al. | 208/89 |
| 5,510,016 | A | 4/1996 | Hilbert et al. | 208/89 |
| 5,554,274 | A | 9/1996 | Degnan et al. | 208/111 |
| 5,770,047 | A | 6/1998 | Salazar et al. | 208/254 R |
| 5,897,768 | A | 4/1999 | McVicker et al. | 208/215 |
| 5,985,136 | A | 11/1999 | Brignac et al. | 208/216 R |
| 6,013,598 | A | 1/2000 | Lapinski et al. | 502/305 |
| 6,126,814 | A | 10/2000 | Lapinski et al. | 208/217 |
| 6,733,660 | B2 * | 5/2004 | Pradhan et al. | 208/218 |
| 2002/0108888 | A1 | 8/2002 | Zanibelli et al. | 208/213 |
| 2002/0166798 | A1 | 11/2002 | Debuisschert et al. | 208/88 |

FOREIGN PATENT DOCUMENTS

| | | |
|---|---|---|
| EP | 0980908 | 2/2000 |
| WO | WO9909117 | 2/1999 |

* cited by examiner

*Primary Examiner*—Glenn Caldarola
*Assistant Examiner*—Prem C. Singh
(74) *Attorney, Agent, or Firm*—J. J. Kliebert; L. E. Carter

(57) ABSTRACT

The instant invention relates to a process to produce high octane, low sulfur naphtha products through the removal of basic nitrogen-containing compounds with subsequent skeletal isomerization of feed olefins and hydrotreating.

35 Claims, No Drawings

PRODUCING LOW SULFUR NAPHTHA PRODUCTS THROUGH IMPROVED OLEFIN ISOMERIZATION

CROSS REFERENCE TO RELATED APPLICATION

This application claims benefit of U.S. Provisional Patent Application Ser. No. 60/492,079 filed Aug. 1, 2003.

FIELD OF THE INVENTION

The instant invention relates to a process for upgrading of hydrocarbon mixtures boiling within the naphtha range. More particularly, the instant invention relates to a process to produce high octane, low sulfur naphtha products through the removal of basic nitrogen-containing compounds with subsequent skeletal isomerization of feed olefins and hydrotreating.

BACKGROUND OF THE INVENTION

Liquid hydrocarbon streams that boil within the naphtha range, i.e., below about 232° C., and produced from the Fluidized Catalytic Cracking Unit ("FCC") are typically used as blending components for motor gasolines. Environmentally driven regulatory pressure concerning motor gasoline sulfur levels is expected to result in the widespread production of less than 50 wppm sulfur mogas by the year 2004. Levels below 10 wppm are being considered for later years in some regions of the world, and this will require deep desulfurization of naphthas in order to conform to emission restrictions that are becoming more stringent. The majority, i.e., 90% or more, of sulfur contaminants present in motor gasolines are typically present in naphtha boiling range hydrocarbon streams. However, the naphtha boiling range streams are also rich in olefins, which boost octane, a desirable quality in motor gasolines.

Thus, many processes have been developed to produce low sulfur products from naphtha boiling range streams while attempting to minimize olefin loss, such as, for example, hydrodesulfurization processes. However, these processes also typically hydrogenate feed olefins to some degree, thus reducing the octane number of the product. Therefore, processes have been developed that recover octane lost during desulfurization. Non-limiting examples of these processes can be found in U.S. Pat. Nos. 5,298,150; 5,320,742; 5,326,462; 5,318,690; 5,360,532; 5,500,108; 5,510,016; and 5,554,274, which are all incorporated herein by reference. In these processes, in order to obtain desirable hydrodesulfurization with a reduced octane loss, it is necessary to operate in two steps. The first step is a hydrodesulfurization step, and a second step recovers octane lost during hydrodesulfurization.

Other processes have also been developed that seek to minimize octane lost during hydrodesulfurization. For example, selective hydrodesulfurization is used to remove organically bound sulfur while minimizing hydrogenation of olefins and octane reduction by various techniques, such as the use of selective catalysts and/or process conditions. For example, one selective hydrodesulfurization process, referred to as SCANfining, has been developed by ExxonMobil Research & Engineering Company in which olefinic naphthas are selectively desulfurized with little loss in octane. U.S. Pat. Nos. 5,985,136; 6,013,598; and 6,126,814, all of which are incorporated by reference herein, disclose various aspects of SCANfining. Although selective hydrodesulfurization processes have been developed to avoid significant olefin saturation and loss of octane, such processes have a tendency to liberate $H_2S$ a portion of which may react with retained olefins to form mercaptan sulfur by reversion.

Thus, there still exists a need in the art for a process to reduce the sulfur content in naphtha boiling range hydrocarbon streams while minimizing octane loss and mercaptan reversion.

SUMMARY OF THE INVENTION

The instant invention is directed at a process for producing low sulfur naphtha products. The process comprises:

a) contacting a naphtha boiling range feedstream containing organically bound sulfur, nitrogen-containing compounds, and olefins in a first reaction zone operated under conditions effective at removing at least a portion of said nitrogen-containing compounds with an acidic material to produce a first reaction zone effluent having a reduced amount of nitrogen-containing compounds;

b) contacting at least a portion of said first reaction zone effluent in a second reaction zone operated under effective hydroisomerization conditions and in the presence of hydrogen-containing treat gas with a second catalyst comprising at least one zeolite having an alpha value in the range of about 1 to about 100 to produce a second reaction zone effluent; and c) hydrotreating at least a portion of the second reaction zone effluent of step b) above in a third reaction zone operated at effective hydrotreating conditions and in the presence of hydrogen-containing treat gas and a third catalyst selected from hydrotreating catalysts comprising about 0.1 to 27 wt. % of a Group VIII metal oxide, about 1 to 45 wt. % of a Group VI metal oxide, and having a median pore diameter of about 60 Å to about 200 Å to produce a desulfurized product.

DETAILED DESCRIPTION OF THE INVENTION

It should be noted that the terms "hydrotreating" and "hydrodesulfurization" are sometimes used interchangeably herein, and the prefixes "i-" and "n" are meant to refer to "iso-" and "normal", respectively.

In the hydrotreating of naphtha boiling range feedstreams, olefins are typically saturated in the hydrotreating zone. As olefins become saturated, the octane number of the desulfurized product decreases. However, the present invention reduces octane loss of the desulfurized product through the use of a novel process involving contacting a naphtha boiling range feedstream containing olefins, organically-bound sulfur, and nitrogen-containing compounds in a first reaction zone containing an acidic material suitable for the removal of nitrogen-containing compounds. The first reaction zone is operated under conditions effective for removing at least a portion of the nitrogen-containing compounds from the naphtha boiling range feedstream. The effluent exiting the first reaction zone is conducted to a second reaction zone containing a second catalyst selected from medium pore zeolites, and the first reaction zone effluent is contacted with the second catalyst in the presence of a hydrogen-containing treat gas under effective hydroisomerization conditions. The contacting of the first reaction zone effluent with the second catalyst produces a second reaction zone effluent. The second reaction zone effluent is then contacted in a third reaction zone operated under effective hydrotreating conditions, and in the presence of hydrogen-containing treat gas, with a third catalyst comprising at least one Group VIII metal oxide and at least one Group VI metal oxide supported, preferably on a suitable substrate.

The desulfurized product thus obtained has a higher iso-paraffin to n-paraffin ratio, and thus a higher octane than a desulfurized naphtha treated by a selective or non-selective hydrotreating process only, i.e., without an octane recovery step. The higher octane of the desulfurized product results from the unexpected finding by the inventors hereof that by operating the second reaction zone under conditions effective for encouraging the skeletal isomerization of n-olefins to iso-olefins results in a desulfurized naphtha product having a higher octane number than a desulfurized product resulting from a selective hydrodesulfurization process only. The inventors hereof have found that the degree of skeletal isomerization of n-olefins to iso-olefins benefits the final product because the saturation of iso-olefins to iso-paraffins that occurs in the third reaction zone herein provides for less octane loss in the final product when compared to the saturation of n-olefins to n-paraffins. It should be noted that iso-paraffins typically have a much higher octane than their corresponding n-paraffin. Further, the rate of saturation of iso-olefins is typically slower than that of n-olefins. Therefore, by increasing the ratio of iso-olefins to n-olefins present in the second reaction zone effluent, the resulting desulfurized naphtha product exiting the third reaction zone has a higher iso-paraffin to n-paraffin ratio, and thus a higher octane than a desulfurized naphtha treated by a selective or non-selective hydrotreating process only.

In the hydroprocessing of naphtha boiling range hydrocarbon feedstreams, it is typically highly desirable to remove sulfur and nitrogen-containing compounds from the naphtha boiling range feedstreams with as little olefin saturation as possible. It is also highly desirable to convert as much of the organic sulfur species of the naphtha to hydrogen sulfide with as little mercaptan reversion as possible. By mercaptan reversion we mean the reaction of hydrogen sulfide with olefins during the hydrotreating to form undesirable alkylmercaptans. The inventors hereof have unexpectedly found that through the use of the presently claimed invention, high levels of sulfur can be removed from an olefinic naphtha stream without excessive olefin saturation or mercaptan reversion taking place.

Feedstreams suitable for use in the present invention include naphtha boiling range refinery streams that typically boil in the range of about 50°(10° C.) to about 450° F. (232° C.) containing olefins as well as nitrogen and sulfur containing compounds. Thus, the term "naphtha boiling range feedstream" as used herein includes those streams having an olefin content of at least about 5 wt. %. Non-limiting examples of naphtha boiling range feedstreams that can be treated by the present invention include fluid catalytic cracking unit naphtha (FCC catalytic naphtha or cat naphtha), steam cracked naphtha, and coker naphtha. Also included are blends of olefinic naphthas with non-olefinic naphthas as long as the blend has an olefin content of at least about 5 wt. %, based on the total weight of the naphtha feedstream.

Cracked naphtha refinery streams generally contain not only paraffins, naphthenes, and aromatics, but also unsaturates, such as open-chain and cyclic olefins, dienes, and cyclic hydrocarbons with olefinic side chains. The olefin-containing naphtha feedstream can contain an overall olefins concentration ranging as high as about 70 wt. %, more typically as high as about 60 wt. %, and most typically from about 5 wt. % to about 40 wt. %. The olefin-containing naphtha feedstream can also have a diene concentration up to about 15 wt. %, but more typically less than about 5 wt. % based on the total weight of the feedstock. The sulfur content of the naphtha feedstream will generally range from about 50 wppm to about 7000 wppm, more typically from about 100 wppm to about 5000 wppm, and most typically from about 100 to about 3000 wppm. The sulfur will usually be present as organically bound sulfur. That is, as sulfur compounds such as simple aliphatic, naphthenic, and aromatic mercaptans, sulfides, di- and polysulfides and the like. Other organically bound sulfur compounds include the class of heterocyclic sulfur compounds such as thiophene, tetrahydrothiophene, benzothiophene and their higher homologs and analogs. Nitrogen can also be present in a range from about 5 wppm to about 500 wppm.

The feedstreams used herein are typically preheated prior to entering the first reaction zone herein and final heating is typically targeted to the effective hydrotreating temperature of the third reaction zone. If the naphtha boiling range feedstream is preheated, it can be reacted with the hydrogen-containing treat gas stream prior to, during, and/or after preheating. At least a portion of the hydrogen-containing treat gas can also be added at an intermediate location in the first reaction zone. Hydrogen-containing treat gasses suitable for use in the presently disclosed process can be comprised of substantially pure hydrogen or can be mixtures of other components typically found in refinery hydrogen streams. It is preferred that the hydrogen-containing treat gas stream contains little, more preferably no, hydrogen sulfide. The hydrogen-containing treat gas purity should be at least about 50% by volume hydrogen, preferably at least about 75% by volume hydrogen, and more preferably at least about 90% by volume hydrogen for best results. It is most preferred that the hydrogen-containing stream be substantially pure hydrogen.

In the first reaction zone, the above-described naphtha boiling range feedstream is contacted with an acidic material suitable for the removal of nitrogen-containing compounds contained in the feedstream. Non-limiting examples of suitable acidic materials include Amberlyst, alumina, sulfuric acid, and any other acidic material known to be effective at catalyzing the removal of nitrogen compounds from a hydrocarbon stream. It should be noted that if sulfuric acid is selected, the sulfuric acid concentration should be selected to avoid polymerization of olefins. Preferred acidic materials include Amberlyst and alumina.

It should be noted that spent sulfuric acid obtained from an alkylation unit could also be used to remove the nitrogen contaminants. In this embodiment, the spent sulfuric acid can be diluted with water to form a sulfuric acid solution having a sulfuric acid concentration suitable for removing nitrogen contaminants. The sulfuric acid solution is typically mixed with the naphtha boiling range feedstream by mixing valves, mixing tanks or vessels, or through the use of a fixed bed or beds of inert materials. After the spent sulfuric acid and naphtha boiling range feedstream have been in contact under effective conditions, the two are allowed or caused to separate into a sulfuric acid solution phase and a first stage effluent, comprising substantially all of the naphtha boiling range feedstream. The first stage effluent is then conducted to the second reaction zone.

The first reaction zone can be comprised of one or more reactors or reaction zones each of which can comprise the same acidic material. In some cases, the acidic material can be present in the form of beds, and fixed beds are preferred. The first reaction zone can employ interstage cooling between reactors, or between beds in the same reactor if present.

The first reaction zone is operated under conditions effective for removal of at least a portion of the nitrogen-containing compounds present in the feedstream to produce a first reaction zone effluent. By at least a portion, it is meant at least about 10 wt. % of the nitrogen-containing compounds present in the feedstream. Preferably, at least that amount of nitrogen-containing compounds that will result in a first reaction zone effluent containing less than about 50 wppm total nitrogen, based on the first reaction zone effluent. More preferably the first reaction zone effluent contains less than 25 wppm total nitrogen, most preferably less than 10 wppm nitrogen, and in an ideally suitable case, less than 5 wppm total nitrogen. Thus, by "conditions effective for removal of at least a portion of the nitrogen-containing compounds", it is meant those conditions under which the first reaction zone effluent will have the above described total nitrogen concentrations, i.e., 10 wt. % removal, etc.

At least a portion, preferably substantially all, of the first reaction zone effluent is then conducted to a second reaction zone wherein it is contacted with a second catalyst effective at isomerizing n-olefins to iso-olefins. Preferred catalysts comprise at least one zeolite. Zeolites are porous crystalline materials and those used herein have an alpha value in the range of about 1 to about 100, preferably between about 2 and 80, more preferably between about 5 and 50, and most preferably between about 10 and about 30. Alpha value, or alpha number, is a measure of zeolite acidic functionality and is more fully described together with details of its measurement in U.S. Pat. No. 4,016,218, J. Catalysis, 6, pages 278-287 (1966) and J. Catalysis, 61, pages 390-396 (1980), which are all incorporated herein by reference. Generally the alpha value reflects the relative activity with respect to a high activity silica-alumina cracking catalyst. To determine the alpha value as used herein, n-hexane conversion is determined at about 800° F. Conversion is varied by variation in space velocity such that a conversion level of 10 to 60 percent of n-hexane is obtained and converted to a rate constant per unit volume of zeolite and compared with that of the silica-alumina catalyst, which is normalized to a reference activity of 1000° F. Catalytic activity is expressed as a multiple of this standard, i.e., the silica-alumina standard. The silica-alumina reference catalyst contains about 10 wt. % $Al_2O_3$ and the remainder is $SiO_2$. Therefore, as the alpha value of a zeolite catalyst decreases, the tendency towards non-selective cracking also decreases.

Zeolites suitable for use in the second reaction zone include both large and medium pore zeolites, with Beta and medium pore zeolites being preferred. Medium pore zeolites as used herein can be any zeolite described as a medium pore zeolite in *Atlas of Zeolite Structure Types*, W. M. Maier and D. H. Olson, Butterworths. Typically, medium pore zeolites are defined as those having a pore size of about 5 to about 7 Angstroms, such that the zeolite freely sorbs molecules such as n-hexane, 3-methylpentane, benzene and p-xylene. Another common classification used for medium pore zeolites involves the Constraint Index test which is described in U.S. Pat. No. 4,016,218, which is hereby incorporated by reference. Medium pore zeolites typically have a Constraint Index of about 1 to about 12, based on the zeolite alone without modifiers and prior to treatment to adjust the diffusivity of the catalyst. Preferred medium pore zeolites for use herein are selected from the group consisting of ZSM-23, ZSM-12, ZSM-22, ZSM-35, ZSM-57, and ZSM-48, with ZSM-48 being the most preferred.

The at least one zeolite used as the second catalyst may be combined with a suitable porous binder or matrix material. Non-limiting examples of such materials include active and inactive materials such as clays, silica, and/or metal oxides such as alumina. Non-limiting examples of naturally occurring clays that can be composited include clays from the montmorillonite and kaolin families including the subbentonites, and the kaolins commonly known as Dixie, McNamee, Georgia, and Florida clays. Others in which the main mineral constituent is halloysite, kaolinite, dickite, nacrite, or anauxite may also be used. The clays can be used in the raw state as originally mixed or subjected to calcination, acid treatment, or chemical modification prior to being combined with the at least one zeolite.

It is preferred that the porous matrix or binder material comprises at least one of silica, alumina, or a kaolin clay. It is more preferred that the binder material comprise alumina. In this embodiment the alumina is present in a ratio of less than about 15 parts zeolite to one part binder, preferably less than about 10, more preferably less than about 5, and most preferably about 2.

The second reaction zone can also be comprised of one or more fixed bed reactors or reaction zones each of which can comprise one or more catalyst beds of the same first catalyst. Although other types of catalyst beds can be used, fixed beds are preferred. Such other types of catalyst beds include fluidized beds, ebullating beds, slurry beds, and moving beds. Interstage cooling between reactors, or between catalyst beds in the same reactor, can be employed since some olefin saturation can take place, and olefin saturation and the desulfurization reaction are generally exothermic. A portion of the heat generated during hydrotreating can be recovered. Where this heat recovery option is not available, conventional cooling may be performed through cooling utilities such as cooling water or air, or through use of a hydrogen quench stream. In this manner, optimum reaction temperatures can be more easily maintained.

As stated above, the above-defined second catalyst is placed in a second reaction zone that is operated under effective hydroisomerization conditions. By effective hydroisomerization conditions, it is meant those conditions that provide for the skeletal isomerization of at least about 10 wt. % of the n-olefins present in the feedstream to iso-olefins, preferably at least about 30 wt. %, more preferably at least about 50 wt. %. By skeletal isomerization, it is meant the reorientation of the molecular structure of the normal olefins with a preference for branched chain iso-olefins over straight. Thus, skeletal isomerization, as used herein, refers to the conversion of a normal olefin to a branched olefin or to the rearranging or moving of branch carbon groups, which are attached to the straight chain olefin molecule, to a different carbon atom, and non-skeletal isomerization can be described as the rearranging of the position of the double bond within the straight chain or branched olefin molecule. These conditions typically include temperatures ranging from about 150° C. to about 425° C., preferably about 200° C. to about 370° C., more preferably about 230° C. to about 350° C. Typical weight hourly space velocities ("WHSV") range from about 0.1 to about 20 $hr^{-1}$, preferably from about 0.5 to about 5 $hr^{-1}$. Any effective pressure can be utilized, and pressures typically range from about 4 to about 70 atmospheres, preferably from about 10 to about 40 atmospheres.

By contacting the first reaction zone effluent with the second catalyst under effective hydroisomerization conditions, a second reaction zone effluent is produced. The second reaction zone effluent thus produced has a higher ratio of iso-olefins to n-olefins. The ratio of iso-olefins to n-olefins in the second reaction zone effluent is greater than the ratio of iso-olefins to n-olefins in the second reaction zone feed, preferably 25% greater, more preferably 50 times greater, most preferably 2 times greater.

At least a portion, preferably substantially all, of the second reaction zone effluent is then passed to a third reaction zone wherein the second reaction zone effluent is contacted with a third catalyst in the presence of a hydrogen-containing treat gas under effective hydrotreating conditions. The third reaction zone can also be comprised of one or more fixed bed reactors or reaction zones each of which can comprise one or more catalyst beds of the same third catalyst. Although other types of catalyst beds can be used, non-limiting examples of suitable bed types include fluidized beds, ebullating beds, slurry beds, and moving beds. Preferred are fixed catalyst beds and it is more preferred that the second and third reaction zones be in the same reaction vessel while the first reaction zone is maintained in a discrete reaction vessel or vessels. Thus, it is within the scope of the present invention that more than one type of catalyst or catalyst bed type be used in the same reaction vessel.

Suitable third catalysts are those that are comprised of at least one Group VIII metal oxide, preferably an oxide of a metal selected from Fe, Co and Ni, more preferably Co and/or Ni, and most preferably Co; and at least one Group VI metal oxide, preferably an oxide of a metal selected from Mo and W, more preferably Mo, on a high surface area support material, such as, for example, at least one of silica, alumina, or a kaolin clay. Other suitable third catalysts include zeolitic catalysts, as well as noble metal catalysts where the noble metal is selected from Pd and Pt. The Group VIII metal oxide of the second reaction zone catalysts is typically present in an amount ranging from about 2 to about 20 wt. %, preferably from about 4 to about 12%. The Group VI metal oxide will typically be present in an amount ranging from about 1 to about 50 wt. %, preferably from about 1 to about 10 wt. %, and more preferably from about 1 to about 5 wt. %. All metal oxide weight percents are on support. By "on support" we mean that the percents are based on the weight of the support. For example, if the support were to weigh 100 g. then 20 wt. % Group VIII metal oxide would mean that 20 g. of Group VIII metal oxide was on the support.

The third catalysts used in the third reaction zone of the present invention are preferably supported catalysts. Any suitable refractory catalyst support material, preferably inorganic oxide support materials may be used as supports for the catalyst of the present invention. Non-limiting examples of suitable support materials include: zeolites, alumina, silica, titania, calcium oxide, strontium oxide, barium oxide, carbons, zirconia, diatomaceous earth, lanthanide oxides including cerium oxide, lanthanum oxide, neodymium oxide, yttrium oxide, and praseodymium oxide; chromia, thorium oxide, urania, niobia, tantala, tin oxide, zinc oxide, and aluminum phosphate. Preferred are alumina, silica, and silica-alumina. More preferred is alumina. Magnesia can also be used for the second reaction zone catalysts. It is to be understood that the support material can also contain small amounts of contaminants, such as Fe, sulfates, silica, and various metal oxides that can be introduced during the preparation of the support material. These contaminants are present in the raw materials used to prepare the support and will preferably be present in amounts less than about 1 wt. %, based on the total weight of the support. It is more preferred that the support material be substantially free of such contaminants. It is an embodiment of the present invention that about 0 to 5 wt. %, preferably from about 0.5 to 4 wt. %, and more preferably from about 1 to 3 wt. %, of an additive be present in the support, which additive is selected from the group consisting of phosphorus and metals or metal oxides from Group IA (alkali metals) of the Periodic Table of the Elements.

Preferred catalysts of the third reaction zone will also have a high degree of metal sulfide edge plane area as measured by the Oxygen Chemisorption Test described in "Structure and Properties of Molybdenum Sulfide: Correlation of $O_2$ Chemisorption with Hydrodesulfurization Activity," S. J. Tauster et al., *Journal of Catalysis* 63, pp 515-519 (1980), which is incorporated herein by reference. The Oxygen Chemisorption Test involves edge-plane area measurements made wherein pulses of oxygen are added to a carrier gas stream and thus rapidly traverse the catalyst bed. For example, the oxygen chemisorption will be from about 800 to 2,800, preferably from about 1,000 to 2,200, and more preferably from about 1,200 to 2,000 μmol oxygen/gram $MoO_3$.

The most preferred third catalysts can be characterized by the properties: (a) a $MoO_3$ concentration of about 1 to 25 wt. %, preferably about 2 to 10 wt. %, and more preferably about 3 to 6 wt. %, based on the total weight of the catalyst; (b) a CoO concentration of about 0.1 to 6 wt. %, preferably about 0.5 to 5 wt. %, and more preferably about 1 to 3 wt. %, also based on the total weight of the catalyst; (c) a Co/Mo atomic ratio of about 0.1 to about 1.0, preferably from about 0.20 to about 0.80, more preferably from about 0.25 to about 0.72; (d) a median pore diameter of about 60 Å to about 200 Å, preferably from about 75 Å to about 175 Å, and more preferably from about 80 Å to about 150 Å; (e) a $MoO_3$ surface concentration of about $0.5\times10^{-4}$ to about $3\times10^{-4}$ g. $MoO_3/m^2$, preferably about $0.75\times10^{-4}$ to about $2.5\times10^{-4}$, more preferably from about $1\times10^{-4}$ to $2\times10^{-4}$; and (f) an average particle size diameter of less than 2.0 mm, preferably less than about 1.6 mm, more preferably less than about 1.4 mm, and most preferably as small as practical for a commercial hydrodesulfurization process unit.

As previously stated, the second reaction zone effluent is contacted with the above-defined third catalyst in a third reaction zone under effective hydrotreating conditions to produce a desulfurized product. By effective hydrotreating conditions, it is meant those conditions chosen that will achieve a resulting desulfurized naphtha product having less than 100 wppm sulfur, preferably less than 50 wppm sulfur, more preferably less than 30 wppm sulfur. These conditions typically include temperatures ranging from about 150° C. to about 425° C., preferably about 200° C. to about 370° C., more preferably about 230° C. to about 350° C. Typical weight hourly space velocities ("WHSV") range from about 0.1 to about 20 $hr^{-1}$, preferably from about 0.5 to about 5 $hr^{-1}$. Any effective pressure can be utilized, and pressures typically range from about 4 to about 70 atmospheres, preferably 10 to 40 atmospheres. It should be noted that although the range of operating conditions for the third reaction zone is similar to that for the second reaction zone, both reaction zones could operate under different conditions. In a most preferred embodiment, the effective hydrotreating conditions are selective hydrotreating conditions configured to achieve a sulfur level within the above-defined sulfur ranges, most preferably the desulfurized naphtha product has a sulfur level sufficiently low to meet current regulatory standards in place at that time. By selective hydrotreating conditions, it is meant conditions such as those contained in U.S. Pat. Nos. 5,985,136; 6,013,598; and 6,126,814, all of which have already been incorporated by reference herein, which disclose various aspects of SCANfining, a process developed by the ExxonMobil Research & Engineering Company in which olefinic naphthas are selectively desulfurized with little loss in octane.

As previously stated, the desulfurized product thus obtained will have a higher iso-paraffin to n-paraffin ratio, and thus a higher octane than a desulfurized naphtha treated by a selective or non-selective hydrotreating process. Typical iso-paraffin to n-paraffin ratios in the desulfurized product resulting from the present process are greater than about 1, preferably about 2, more preferably about 3. Thus, compared to selective hydrodesulfurization catalyst systems, the processing of the naphtha boiling range feedstream over the present catalyst system results in a desulfurized naphtha product with a higher octane at constant olefin saturation even when both catalyst systems maintain similar desulfurization/olefin saturation selectivity.

The above description is directed to several embodiments of the present invention. Those skilled in the art will recognize that other embodiments that are equally effective could be devised for carrying out the spirit of this invention.

The following examples will illustrate the improved effectiveness of the present invention, but is not meant to limit the present invention in any fashion.

EXAMPLES

Example 1

An FCC naphtha was treated with acidic materials (Amberlyst-15 and alumina) to remove nitrogen-containing compounds. The naphtha feed having a reduced amount of nitrogen compounds was used in the present example, and its properties are outlined in Table 1 below. Throughout the following examples, i-olefins and i-paraffins is meant to refer to iso-olefins and iso-paraffins, and, n-olefins and n-paraffins is meant to refer to normal-olefins and normal-paraffins.

TABLE 1

| | |
|---|---|
| API Gravity | 56 |
| Sulfur | 606 wppm |
| Nitrogen | 1 wppm |
| Bromine Number | 72 |
| Research Octane Number | 92.1 |
| N-Parraffins | 3.22 wt. % |
| I-Paraffins | 23.22 wt. % |
| Naphthenes | 8.38 wt. % |
| Aromatics | 29.69 wt. % |
| N-Olefins | 11.95 wt. % |
| I-Olefins | 17.35 wt. % |
| Other Olefins | 6.20 wt. % |
| Distillation | ASTM D2287 |
| 10% | 42° C. |
| 30% | 79° C. |
| 50% | 109° C. |
| 70% | 138° C. |
| 90% | 174° C. |

The feed described in Table 1 above was then treated with a 5 cc loading of 4 different zeolite catalysts, see Table 2 below, under identical processing conditions. Each of the four zeolite catalysts was in the form of an extrudate with a 65/35 zeolite/alumina ratio. The extrusion was carried out in a 2" Bonnot extruder with a 1/16" cylindrical or quadralobe die plate. After extrusion, the catalyst samples were dried and then precalcined in nitrogen at 900° F. for 3 hours to remove the organic template. This was followed by an ammonium exchange step with 1N ammonium nitrate solution to reduce the sodium level to below 500 wppm. The catalyst samples were then subjected to a hybrid calcination with nitrogen precalcination at 900° F. for 1 hour followed by air calcination at 1000° F. for 6 hours. The alpha value of the catalysts was measured according to the test described above, and the surface area was measured using ASTM D3663. The catalyst properties are contained in Table 2 below.

TABLE 2

| Catalyst | Zeolite | Alpha | Surface Area ($m^2/g$) |
|---|---|---|---|
| A | Beta | 0.7 | 342 |
| B | Beta | 7 | 393 |
| C | ZSM-23 | 4.8 | 230 |
| D | ZSM-48 | 6 | 229 |

The feed described above was treated with each catalyst separately. The processing conditions included a liquid hourly space velocity (LHSV) of 1.0 $hr^{-1}$, a hydrogen treat gas rate of 178 $Nm^3/m^3$ of substantially pure hydrogen, and a total system pressure of 18 atm, and a temperature of 260° C. Table 3 below indicates the catalyst used in each experiment and the results of the experiment. Net olefin isomerization was calculated by using the formula:

100×(iso-olefin in product−iso-olefin in feed)/(n-olefin in feed−n-olefin in product).

TABLE 3

| | | Catalyst | | | |
|---|---|---|---|---|---|
| | | A | B | C | D |
| | | Zeolite | | | |
| | | Beta | Beta | ZSM-23 | ZSM-48 |
| | | Alpha | | | |
| | Feed | 0.70 | 7.00 | 4.80 | 6.00 |
| N-paraffins wt. % | 3.22 | 5.14 | 4.00 | 3.22 | 5.67 |
| I-paraffins wt. % | 23.22 | 22.72 | 23.82 | 23.85 | 23.80 |
| Napthenes wt. % | 8.38 | 7.23 | 8.45 | 8.70 | 8.75 |
| Aromatics wt. % | 29.69 | 28.92 | 27.49 | 28.23 | 28.60 |
| N-olefins wt. % | 11.95 | 11.86 | 11.86 | 7.12 | 8.35 |
| I-olefins wt. % | 17.35 | 19.08 | 18.62 | 21.27 | 19.76 |
| other olefins wt. % | 6.20 | 5.06 | 5.77 | 6.99 | 5.09 |
| N-olefin conversion % | | 0.80 | 0.80 | 40.40 | 30.10 |
| Net olefin isomerization % | | | | 81.20 | 66.90 |
| I-parrafins + I-olefins wt. % | 40.60 | 41.80 | 42.40 | 45.10 | 43.60 |

Example 2

Three catalysts comprising ZSM-48 and alumina were prepared according to the process outlined in Example 1 above except Catalyst E was also treated by steaming the catalyst at 1250° F. for 2 hours in 100% steam after the hybrid calcination step, and Catalyst G was prepared by modifying the hybrid calcination step with an initial air treatment at 900° F. for 3 hours followed by steaming at 900° F. for 3 hours in 100% steam. Each of these three catalysts contained 65 wt. % zeolite and 35 wt. % alumina. The feed described in Table 1 above was treated with these under the same processing conditions described in Example 1 above. The catalyst properties along with the results of the experiments are described in Tables 4 and 5 below, respectively.

TABLE 4

| Catalyst | Zeolite | Alpha |
|---|---|---|
| E | ZSM-48 | 6 |
| F | ZSM-48 | 15 |
| G | ZSM-48 | 37 |

TABLE 5

| | | Catalyst | | |
|---|---|---|---|---|
| | | E | F | G |
| | | Zeolite | | |
| | | ZSM-48 | ZSM-48 | ZSM-48 |
| | | Alpha | | |
| | Feed | 6.00 | 15.00 | 37.00 |
| N-paraffins wt. % | 3.22 | 5.67 | 5.39 | 5.67 |
| I-paraffins wt. % | 23.22 | 23.80 | 26.29 | 26.10 |
| Napthenes wt. % | 8.38 | 8.75 | 8.80 | 8.66 |
| Aromatics wt. % | 29.69 | 28.60 | 30.30 | 28.53 |
| N-olefins wt. % | 11.95 | 8.35 | 4.96 | 4.61 |
| I-olefins wt. % | 17.35 | 19.76 | 20.31 | 22.04 |
| other olefins wt. % | 6.20 | 5.09 | 3.95 | 5.99 |
| N-olefin conversion % | | 30.10 | 58.50 | 61.40 |
| Net olefin isomerization % | | 66.90 | 42.30 | 63.90 |
| I-parrafins + I-olefins wt. % | 40.60 | 43.60 | 46.60 | 48.10 |

Example 3

Four more 5 cc loadings of different catalysts were also analyzed. These four catalysts were prepared according to the procedure outlined in Example 1 also except Catalyst J was prepared by steaming Catalyst H for 8 hours at 1200° F. after the hybrid calcination step. Each of the catalysts contained the same 65/35 ratio of zeolite to alumina binder described above, and each was used to treat the feed described in Table 7 below under the process conditions described in Example 1. The properties of these catalysts are listed in Table 6 below, and the results of the experiments are given in Table 7 below.

TABLE 6

| Catalyst | Zeolite | Alpha |
|---|---|---|
| H | MCM-22 | 220 |
| I | ZSM-35 | 65 |
| J | MCM-22 | 43 |
| K | ZSM-12 | 40 |

TABLE 7

| | | Catalyst | | | |
|---|---|---|---|---|---|
| | | H | I | J | K |
| | | Zeolite | | | |
| | | MCM-22 | ZSM-35 | MCM-22 | ZSM-12 |
| | | Alpha | | | |
| | Feed | 220.00 | 65.00 | 43.00 | 40.00 |
| N-paraffins wt. % | 3.27 | 4.29 | 7.12 | 9.94 | 3.27 |
| I-paraffins wt. % | 26.95 | 57.02 | 23.16 | 23.61 | 26.95 |
| Napthenes wt. % | 10.29 | 11.78 | 7.72 | 8.42 | 10.29 |
| Aromatics wt. % | 29.46 | 26.27 | 28.34 | 26.69 | 29.46 |

TABLE 7-continued

| | | Catalyst | | | |
|---|---|---|---|---|---|
| | | H | I | J | K |
| | | Zeolite | | | |
| | | MCM-22 | ZSM-35 | MCM-22 | ZSM-12 |
| | | Alpha | | | |
| | Feed | 220.00 | 65.00 | 43.00 | 40.00 |
| N-olefins wt. % | 8.76 | 0.11 | 5.25 | 9.23 | 8.76 |
| I-olefins wt. % | 17.25 | 0.49 | 21.22 | 17.66 | 17.25 |
| other olefins wt. % | 4.02 | 0.04 | 7.18 | 4.44 | 4.02 |
| N-olefin conversion % | | 98.70 | 40.10 | −5.40 | 0.00 |
| Net olefin isomerization % | | | | | |
| I-parrafins + I-olefins wt. % | 44.20 | 57.50 | 44.40 | 41.30 | 44.20 |

As shown in Table 7 above, highly acidic catalysts such as Catalyst H promote undesirable side reactions such as the conversion of i-olefins. Thus, catalysts having an alpha value between about 1 and about 100 outperform those catalysts outside of this range.

The invention claimed is:

1. A process for producing low sulfur naphtha products comprising:

a) contacting a naphtha boiling range feedstream containing organically bound sulfur, nitrogen-containing compounds, and olefins in a first reaction zone operated under conditions effective to remove at least a portion of said nitrogen-containing compounds with an acidic material to produce a first reaction zone effluent having a reduced amount of nitrogen-containing compounds;

b) contacting at least a portion of said first reaction zone effluent in a second reaction zone operated under effective hydroisomerization conditions and in the presence of hydrogen-containing treat gas with a second catalyst comprising ZSM-48 having an alpha value in the range of about 1 to about 100 to produce a second reaction zone effluent; and c) hydrotreating at least a portion of the second reaction zone effluent of step b) above in a third reaction zone operated at effective hydrotreating conditions and in the presence of hydrogen-containing treat gas and a third catalyst selected from hydrotreating catalysts comprising about 0.1 to 27 wt. % of a Group VIII metal oxide, about 1 to 45 wt. % of a Group VI metal oxide, and having a median pore diameter of about 60 Å to about 200 Å to produce a desulfurized product.

2. The process of claim 1 wherein said first reaction zone comprises one or more reactors or reaction zones.

3. The process according to claim 2 wherein said second and third reaction zones comprise one or more catalyst beds selected from the group consisting of fluidized beds, ebullating beds, slurry beds, fixed beds, and moving beds wherein each of said one or more catalyst beds contains a catalyst suitable for the reaction zone in which the catalyst bed is located.

4. The process of according to claim 1 wherein said desulfurized product contains less than 100 wppm sulfur.

5. The process according to claim 3 wherein said second and third reaction zones are located in the same reaction vessel.

6. The process according to claim 5 wherein said second and third reaction zones comprise one or more fixed catalyst beds.

7. The process according to claim 2 wherein said process further comprises interstage cooling between said first, second, and third reaction zones, or between catalyst beds in said first, second, and third reaction zones.

8. The process according to claim 2 wherein said acidic material is selected from Amberlyst, alumina, sulfuric acid, spent sulfuric acid obtained from an alkylation unit, and any other acidic material known to be effective at removing nitrogen compounds from a hydrocarbon stream.

9. The process according to claim 1 wherein said third catalyst is a hydrotreating catalyst comprising about 4 to about 12% of a Group VIII metal oxide and about 10 to about 40 wt. % of a Group VI metal oxide.

10. The process according to claim 1 wherein said third catalyst is a hydrotreating catalyst comprising about 1 to 25 wt. % MoO3, about 0.1 to 6 wt. % CoO wherein said CoO and MoO3 are present in an atomic ratio of about 0.1 to about 1.0 Co/Mo, and said catalyst has a median pore diameter of about 75 Å to about 175 Å, wherein said third catalyst has a MoO3 surface concentration of about 0.5× 10-4 to about 3×10-4 g/m2 g and an average particle size diameter of less than 2.0 mm.

11. The process according to claim 10 wherein said effective hydroisomerization conditions are selected to cause skeletal isomerization of the olefins present in said naphtha boiling range feedstream.

12. The process according to claim 11 wherein said second reaction zone effluent has a higher ratio of iso-olefins to n-olefins than the naphtha boiling range feedstream.

13. The process according to claim 10 wherein said third catalyst further comprises a suitable binder or matrix material selected from zeolites, alumina, silica, titania, calcium oxide, strontium oxide, barium oxide, carbons, zirconia, diatomaceous earth, lanthanide oxides including cerium oxide, lanthanum oxide, neodymium oxide, yttrium oxide, and praseodymium oxide; chromia, thorium oxide, urania, niobia, tantala, tin oxide, zinc oxide, and aluminum phosphate.

14. The process according to claim 13 wherein said suitable binder or matrix support of said second catalyst also contains less than about 1 wt. % of contaminants, such as Fe, sulfates, silica, and various metal oxides that can be introduced during the preparation of the support.

15. The process according to claim 13 wherein said suitable binder or matrix support of said third catalyst also contains about 0 to 5 wt. % of an additive selected from the group consisting of phosphorus and metals or metal oxides from Group IA (alkali metals) of the Periodic Table of the Elements.

16. The process according to claim 13 wherein said suitable binder or matrix material is selected from alumina, silica, and silica-alumina.

17. The process according to claim 16 wherein said suitable binder or matrix material is alumina.

18. The process according to claim 10 wherein said second catalyst further comprises a suitable porous binder or matrix material selected from clays, silica, and/or metal oxides such as alumina.

19. The process according to claim 18 wherein said suitable porous binder or matrix material is selected from silica, alumina, or a kaolin clay.

20. The process according to claim 19 wherein said suitable porous binder or matrix material is alumina present in a ratio of less than about 15 parts zeolite to one part binder.

21. The process according to claim 20 wherein said effective hydrotreating conditions are selected in such a manner that said desulfurized naphtha product has a sulfur level less than 50 wppm sulfur.

22. The process according to claim 21 wherein said effective hydrotreating conditions are selective hydrotreating conditions.

23. The process according to claim 21 wherein said desulfurized naphtha product has a higher concentration of iso-paraffins than n-paraffins.

24. A process for producing low sulfur naphtha products comprising;

a) contacting a naphtha boiling range feedstream containing organically bound sulfur, nitrogen-containing compounds, and olefins in a first reaction zone operated under conditions effective to remove at least a portion of said nitrogen-containing compounds with an acidic material selected from amberlyst and alumina to produce a first reaction zone effluent having less than 50 wppm total nitrogen;

b) contacting at least a portion of said first reaction zone effluent in a second reaction zone operated under effective hydroisomerization conditions and in the presence of hydrogen-containing treat gas with a second catalyst comprising at least one zeolite selected from ZSM-23 and ZSM-48 and having an alpha value in the range of about 2 to about 80 to produce a second reaction zone effluent; and c) hydrotreating at least a portion of the second reaction zone effluent of step b) above in a third reaction zone operated under effective hydrotreating conditions and in the presence of hydrogen-containing treat gas and a third catalyst selected from hydrotreating catalysts comprising about 1 to 25 wt. % $MoO_3$, about 0.1 to 6 wt. % CoO wherein said CoO and $MoO_3$ are present in an atomic ratio of about 0.1 to about 1.0 Co/Mo, and said third catalyst has a median pore diameter of about 75 Å to about 175 Å, wherein said third catalyst has a $MoO_3$ surface concentration of about $0.75\times10^{-4}$ to about $2.5\times10^{-4}$ g/m$^2$ and an average particle size diameter of less than 2.0 mm to produce a desulfurized product having a sulfur level less than 100 wppm sulfur.

25. The process according to claim 24 wherein said first reaction zone effluent contains less than 25 wppm total nitrogen.

26. The process according to claim 25 wherein said second catalyst is ZSM-48.

27. The process according to claim 26 wherein said third catalyst is a hydrotreating catalyst comprising about 2 to 10 wt. % MoO3, about 0.5 to 5.0 wt. % CoO wherein said CoO and MoO3 are present in an atomic ratio of about 0.20 to about 0.80 Co/Mo, and said catalyst has a median pore diameter of about 75 Å to about 175 Å, wherein said second catalyst has a MoO3 surface concentration of about 0.5× 10-4 to about 3×10-4 g/m2 and an average particle size diameter of less than 1.6 mm.

28. The process according to claim 27 wherein said effective hydroisomerization conditions are selected to cause skeletal isomerization of the olefins present in said naphtha boiling range feedstream.

29. The process according to claim 27 wherein said third catalyst further comprises a suitable binder or matrix material selected from alumina, silica, and silica-alumina.

30. The process according to claim 29 wherein said second catalyst further comprises a suitable porous binder or matrix material selected from clays, silica, and/or metal oxides such as alumina.

31. The process according to claim 30 wherein said second catalyst further comprises alumina present in a ratio of less than about 15 parts zeolite to one part binder.

32. The process according to claim 30 wherein said effective hydrotreating conditions are selected in such a manner that said desulfurized naphtha product has a sulfur level less than 50 wppm sulfur.

33. The process according to claim 32 wherein said effective hydrotreating conditions are selective hydrotreating conditions.

34. The process according to claim 31 wherein said desulfurized naphtha product has a higher concentration of iso-paraffins than n-paraffins.

35. A process for producing low sulfur naphtha products from an olefin and sulfur containing naphtha boiling range feedstream comprising:

a) contacting a naphtha boiling range feedstream containing organically bound sulfur, nitrogen-containing compounds, and olefins in a first reaction zone operated under conditions effective to remove at least a portion of said nitrogen-containing compounds with a first catalyst selected from Amberlyst and alumina to produce a first reaction zone effluent having less than 10 wppm total nitrogen;

b) contacting said first reaction zone effluent in a second reaction zone operated under effective hydroisomerization conditions selected to cause skeletal isomerization of said olefins contained in said feedstream and in the presence of hydrogen-containing treat gas with a second catalyst comprising ZSM-48 and an alumina binder, wherein said binder and ZSM-48 are present in a ratio of less than about 15 parts zeolite to one part binder, to produce a second reaction zone effluent having a higher ratio of iso-olefins to n-olefins than the naphtha boiling range feedstream; and c) hydrotreating the second reaction zone effluent of step b) above in a third reaction zone operated under selective hydrotreating conditions and in the presence of hydrogen-containing treat gas and a third catalyst selected from supported hydrotreating catalysts comprising about 3 to 6 wt. % $MoO_3$, about 1 to 3 wt. % CoO wherein said CoO and $MoO_3$ are present in an atomic ratio of about 0.25 to about 0.72 Co/Mo, and said third catalyst has a median pore diameter of about 80 Å to about 150 Å, wherein said second catalyst has a $MoO_3$ surface concentration of about $1\times10^{-4}$ to $2\times10^{-4}$ g/m$^2$ and an average particle size diameter of less than 1.4 mm to produce a desulfurized product having a sulfur level less than 50 wppm sulfur and a higher concentration of iso-paraffins than n-paraffins.

* * * * *